United States Patent [19]

Alfaro

[11] Patent Number: 4,911,222

[45] Date of Patent: Mar. 27, 1990

[54] LIQUID METAL DISTRIBUTION SYSTEM IN BILLET MOULDS

[75] Inventor: Ingnacio Alfaro, Bilbao, Spain

[73] Assignee: Remetal, S.A., Vizcaya, Spain

[21] Appl. No.: 305,259

[22] Filed: Feb. 2, 1989

[30] Foreign Application Priority Data

Feb. 3, 1988 [ES] Spain ..... 8800301

[51] Int. Cl.[4] ..... B22D 5/00; B22D 37/00

[52] U.S. Cl. ..... 164/323; 164/324; 164/335; 164/337

[58] Field of Search ..... 164/130, 133, 134, 136, 164/322, 324, 303, 329, 335, 337; 222/594, 606, 607, 629

[56] References Cited

U.S. PATENT DOCUMENTS 2,199,598 5/1940 Robbins ..... 164/324

3,972,368 8/1976 Kikkawa et al. ..... 164/134

*Primary Examiner*—Richard K. Seidel

*Attorney, Agent, or Firm*—Browdy and Neimark

[57] ABSTRACT

A system for filling billet moulds, especially with liquid aluminium, in which a flume (1) is situated fundamentally horizontally with a downwards spout at one end, with the liquid metal flowing along the said flume (1). The spout deposits the metal on a horizontally arranged V cross section bucket (17), with upward concave arms. The upper arm has an access hole (18) for metal towards the other arm, which finished in a horizontal end near the bottom of the billet mould. The buckets are situated on a rotating bucket (6) elevator and the flume tilts, as does the bucket elevator.

8 Claims, 3 Drawing Sheets

LIQUID METAL DISTRIBUTION SYSTEM IN BILLET MOULDS

FIELD OF THE INVENTION

The patent refers to the filling of billet moulds in automatic billeting lines, more particularly in the aluminium and alloying industry.

BACKGROUND OF THE INVENTION

In traditional mechanisms, deficiencies have been observed; one of them is derived from the formation of surface scum or dross on ingots or billets which normally must be removed, and the other of these deficiencies stems from the breakage of the billet mould when it comes in contact with a billet not removed from the mould. All this usually makes it necessary to construct complex, noisy automated devices, in order to avoid the above-mentioned deficiencies.

SUMMARY OF THE INVENTION

The object of the present invention is to obtain a device and a operative method for filling billet moulds, by means of which the billets are produced free of scum or dross and, therefore, are internally healthy, free of gases, etc.

Another object of the present invention is to achieve equal filling of all th billet moulds.

Another object of the present invention is to provide a system or method of operation which is simple and has a long service life, which does not break when faced with normal foundry problems and which is also easy to maintain.

To achieve these objectives, the present invention gives a laminar movement to the metal to the bottom of the billet moulds. Taking into accound that the greatest speed components of the liquid is horizontal, we will try to succeed in carrying out pouring in steps and without obstacles in this horizontal movement, while at the same time minimizing the drop in height.

Taking into account that the liquid metal arrives at the billet moulds along a flume, the present invention provides a bucket elevator type device which is preferably geared with the billet moulds, with which the metal does not find any obstacles in its route from the flume and is gently led towards the bottom of the said billet moulds.

According to the present invention, the bucket elevator is equipped witha series of specially shaped buckets, through which the metal slides towards the bottom of the billet mould, through one of its ends.

The bucket elevator, together with the buckets, is situated vertically and the flume along which the liquid metal flows accedes to the buckets on board the bucket elevator, so that each one of the buckets penetrates into the inside of the billet mould and very near its bottom. The buckets are specially shaped, as will be described later.

The bucket elevator is mounted on an axis which allows it to rotate, and the other end of this axis is in turn mounted on two bearings that are supported by a tilting structure, which, operated by an item such as a jack, for instance, can be raised and lowered at will. Between the bucket elevator and the bearnings, the bucket elevator axis carries a draw pinion, which is geared with the billet mould chain in such a way that movement of the billet moulds causes circular movement of the bucket elevator, through the said pinion.

Evidently, the number of buckets on the bucket elevator will be arranged and adjusted so that when the assembly is in operation, a bucket from the bucket elevator will be situated over a billet mould and will penetrate into the said billet mould and reach near its bottom. At this moment, the spout end of the flume penetrates inside the bucket of the bucket elevator and pors the liquid metal on the bucket, which deposits it in the billet mould.

Each bucket has a raised portion on the side near the flume, whose spout end goes beyond this raised portion and penetrates into the bucket. Starting from this raised portion the bucket has a concave surface towards the upper part, where there is a hole cut just near the end of the flume spout, and the liquid metal passes through this hile towards another lower surface of another area of the bucket situated below the previous one.

The last area of the bucket is inclined gently upwards and ends in a horizontal outlet towards the billet mould, with which the liquid metal is gently deposited on the bottom of the billet mould.

The bucket elevator provides a lower area in each position during its rotation, in which the liquid metal that arrives from the flume is stored, so that when the position of a bucket coincides with that of a billet mould, the liquid metal escapes towards the outlet of the said bucket through the hole.

Using this technique, the best results are achieved with bucket elevators that have 18 buckets and 18 holes. A production of 10 tons per hour can pass through a 45 mm. diameter hole with billet mould pitches or steps of between 180 and 250 mm.

Usually, the bucket elevators are manufactured of grey-iron casting or cast steel, the reason why they never die because of the attack of liquid aluminium coming from the feeding flume.

The bucket elevators are cold and it is necessary to preheat them so that the metal does not solidify in contact witht hem. To this effect, a wall thickness has been calculated such that if the aluminium is sufficiently heated to circulate through the pouring hole, no heating is needed during casting, but only preheating. To do this, it has been agreed that the most suitable method is a propane gas generator.

As was stated earlier, the bucket elevator is equipped with its own raising system, which becomes necessary when, for any cause, the billet mould chain stops, with the billet moulds full of metal and with the bucket of the bucket elevator inserted. In this situation, sili dification of this metal would lead to breakage of the bucket and the death of the bucket elevator.

Generally, the bucket elevator could, in such an event, be driven or moved by the buckets themselves, and in many cases it is installed in this way. However, when alloys of a greater viscosity are used, there is the risk that the draw mark will appear on the ingots or billets. For this, a drive pinion is fitted which centres the bucket in the billet mould.

The arrival channel for the liquid metal is made up of a bucket elevator caising of grey-iron casting and an arrival casing also of grey-iron casting. The bucket elevator is made of grey-iron casting or cast steel and has a minimum wall thickness of some 8 mm.

BRIEF DESCRIPTION OF THE DRAWINGS

All these and other details of the patent will be observed in relation to the sheet of drawings which is adjoined, in which, only as a guide, the following are represented.

DETAILED DESCRIPTION OF THE INVENTION

Figure 1:
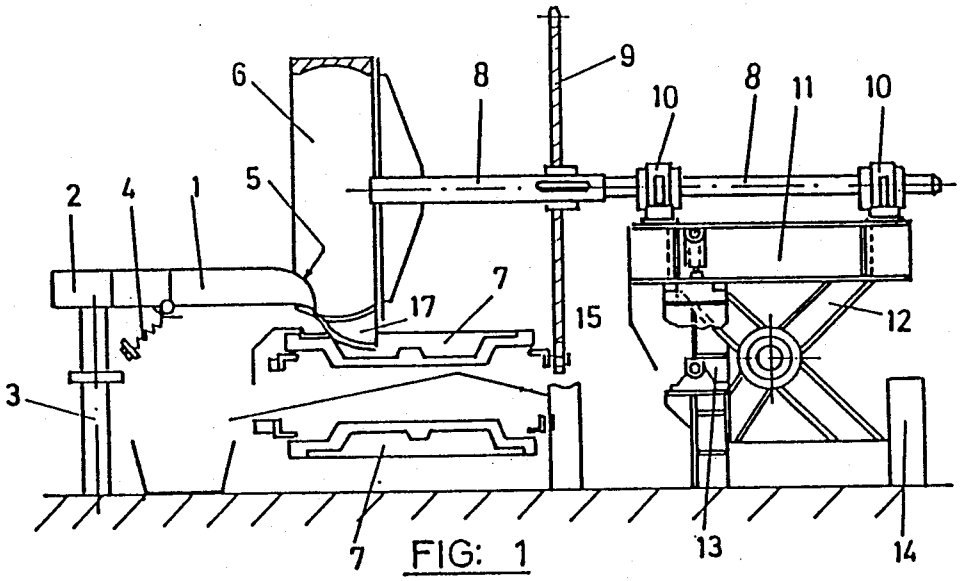
FIG. 1 is a general elevation of the apparatus according to the present invention.

In accordance with these figures, we will point out firstly in FIG. 1 the flume (1) for liquid metal access towards the billet moulds (7) in the billet mould chain which have to be filled. The front end (5) of the flume (1) proceeds towards the inside of the bucket elevator (6), which is arranged vertically over the billet moulds (7). The bucket elevator is mounted on an axis (8) which is supported on the bearings (10) situated on the tilting structure (11), which can be raised by the mechanism (12) and the jack (13), all of which is operated from the control position (14).

On the axis (8) is fitted the draw pinion (9), which is connected, in this case, to the billet mould chain (15), so that the movement of the billet mould chain is adjusted to the turning of the bucket elevator (6), in order that the different buckets correspond during the said turning with the position of a billet mould.

Figure 2:
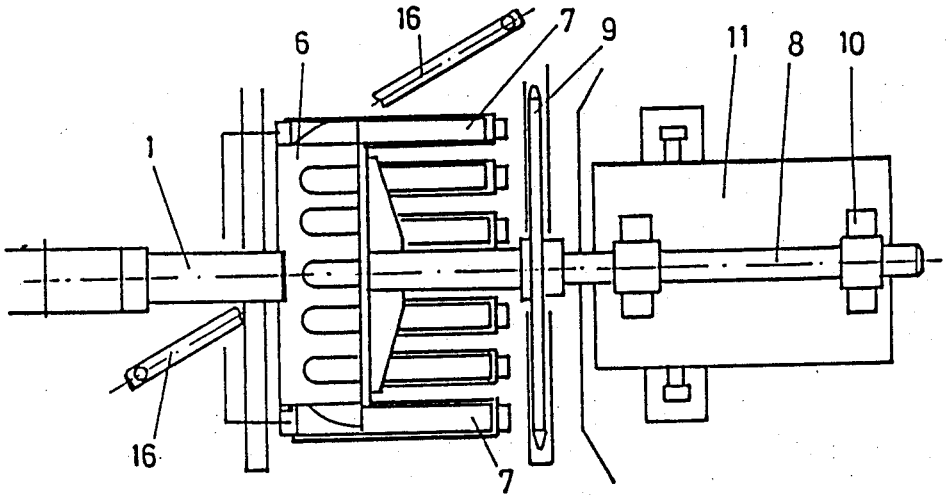
FIG. 2 is view of the apparatus shown in FIG. 1

In FIG. 2, the top view of the above shows the position of the burners (16) for heating or preheating the bucket elevator (6).

Figure 3:
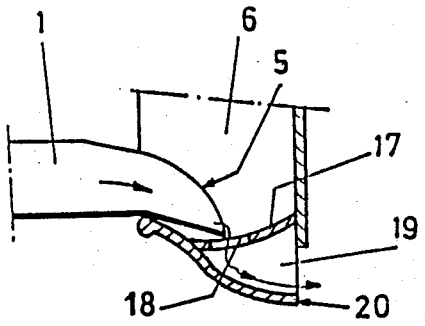
FIG. 3 is a detail of the arrival of the flume towards one of the buckets of the bucket elevator, in accordance with the present invention.
Figure 4:
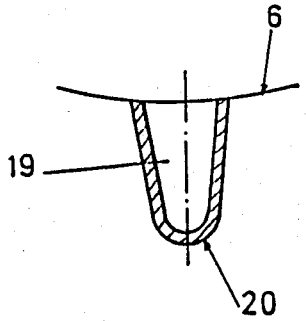
FIG. 4 is a right view of the apparatus shown in FIG. 1.
Figure 5:
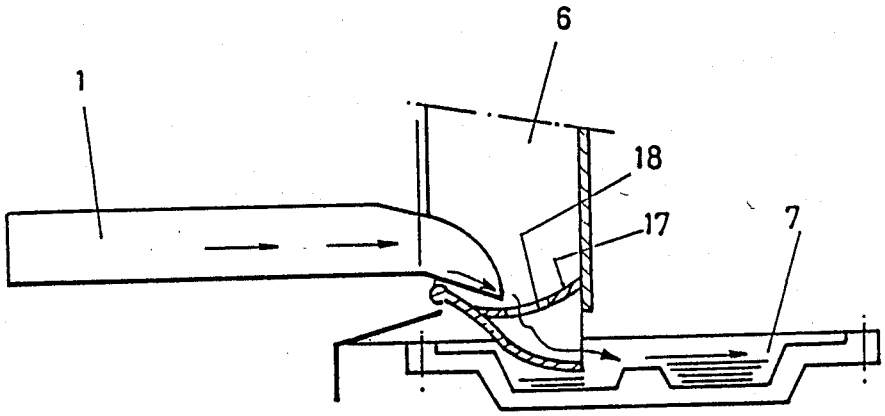
FIG. 5 is an enlarged detail of the arrival of the flume at the bucket of the bucket elevator, and how this bucket becomes inserted near the bottom of the billet mould.

As regards FIG. 3, it can be seen how the spout (5) at the end of the flume (1) is directed towards the inside of the bucket elevator in such a way that on arrival of the liquid metal, it is deposited in the interior of the bucket elevator. At the same time as the bucket elevator (6) turns, the spout (5) coincides with the buckets (17) and, more precisely, with the holes (18) cut in its upper base, just at the billet mould (7 - FIG. 5) and near the bottom of it. The liquid metal flows towards the lower portion of the bucket and from there and by the surface (20), it goes out through the side opening (19) (FIGS. 3, 4 and 5).

The liquid metal is thus given a laminar movement to the bottom of the billet mould, with a minimum height drop and without any steps.

The lifting mechanism (11)-(12)-(13) allows the bucket elevator (6) to be raised to extract the bucket (17) from the bottom of the billet mould, when, for any reason, the billet mould chain stops. In this case, the end (1) of the bucket is raised from the portion (2) and over the base (3).

The bucket elevator (6) is centred inside the billet mould be adjustment of the bearings (10) that support the axis (8). In the same way, the elevation of the bucket elevator is adjusted so that the arrival flume does not leave the bucket elevator field.

It is important to emphasize, once that the nature and advantages of this invention have been described, that it has a non-restrictive character, in that changes in the shape, material or sizes of its constituent parts will not in any way alter its essence, as long as they do not mean a substantial variation of the whole.

I claim:

1. A metal casting apparatus comprising:
a plurality of molds set on chain conveyor means;
dispensing means including a horizontal flume; and
bucket elevator means comprising a plurality of buckets mounted on a rotatable axis, each said bucket including a raised portion on the side thereof near the flume, and a concave surface towards the upper part thereof, and a hole in said concave surface near the end of the flume;
wherein upon rotation of said elevator, one of said buckets is disposed intermediate the flume and mold, thereby enabling a substantially laminar flow of molten metal from the dispensing means to the mold bottom.

2. A metal castng apparatus in accordance with claim 1 wherein said bucket elevator is mounted on an axis which permits rotation of said bucket, one end of said axis supporting said bucket and the other end of said axis mounted on two bearings supported on a tilting structure.

3. A metal casting apparatus in accordance with claim 2 further including a draw pinion located between said bucket elevator and said bearings, said draw pinion geared with a billet mold chain.

4. A metal casting apparatus in accordance with claim 1 wherein said flume is made of grey-iron casting.

5. A metal casting apparatus in accordance with claim 1 wherein said buckets are made of cast steel.

6. A metal casting apparatus in accordance with claim 1 wherein said buckets are preheated.

7. A metal casting apparatus in accordance with claim 6 wherein said buckets are preheated by means of gas burners.

8. A metal casting apparatus in accordance with claim 1 wherein said bucket elevator is provided with a lifting system having a scissor arrangement.

* * * * *